US006119661A

United States Patent [19]

DeLand et al.

[11] Patent Number: 6,119,661

[45] Date of Patent: Sep. 19, 2000

[54] PRESSURE COMPENSATING VAPOR MANAGEMENT VALVE

[75] Inventors: Daniel L. DeLand, Davison; Charles A. Detweiler, Durand; Gerrit V. Beneker, Algonac, all of Mich.

[73] Assignee: Eaton Corporation, Cleveland, Ohio

[21] Appl. No.: 09/135,602

[22] Filed: Aug. 18, 1998

[51] Int. Cl.[7] ..... F02M 37/04

[52] U.S. Cl. ..... 123/520; 123/458; 123/516

[58] Field of Search ..... 123/516, 518, 123/519, 520, 458; 251/129.07

[56] References Cited

U.S. PATENT DOCUMENTS

| | | | |
|---|---|---|---|
| 5,277,167 | 1/1994 | DeLand et al. | 123/518 |
| 5,749,349 | 5/1998 | Detweiler et al. | 123/520 |
| 5,853,018 | 12/1998 | Deland et al. | 137/15 |
| 5,893,354 | 4/1999 | Detweiker | 123/520 |
| 5,967,487 | 10/1999 | Cook et al. | 251/129.07 |

*Primary Examiner*—Henry C. Yuen
*Assistant Examiner*—Arnold Castro
*Attorney, Agent, or Firm*—Roger A. Johnston

[57] ABSTRACT

A fuel tank vapor management valve (VMV) for controlling purge flow from a vapor storage canister to an engine inlet manifold. In one embodiment, an existing VMV utilizing an electrically operated atmospheric bleed valve or EVR for controlling vacuum pressure on one side of the regulator valve diaphragm is modified to have an additional vacuum ported valve seat in the EVR to be opened and closed by the bleed valve instead of providing a vacuum port in the regulator diaphragm signal pressure chamber. The inlet of the EVR is connected to the storage canister instead of being ported to the atmosphere which equalizes canister pressure across the regulator diaphragm thus preventing undesired opening of the regular valve when the engine is shut off. In another embodiment, an existing VMV is unmodified, with the EVR bleed port connected to the canister and the shut-off valve is connected in the line connecting the engine manifold with the regulator valve diaphragm signal pressure chamber. The shut-off valve may be either electrically operated or pressure actuated by engine manifold vacuum.

11 Claims, 4 Drawing Sheets

PRESSURE COMPENSATING VAPOR MANAGEMENT VALVE

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to electrically operated vacuum regulator valves employed for controlling purge flow of fuel vapors from a storage device, typically a charcoal filled canister, employed to trap fuel vapors from a fuel tank. Such valves are employed on current production light motor vehicles for controlling the emissions of evaporative hydrocarbons into the atmosphere and are referred to as Vapor Management Valves (VMV).

An example of an electrically operated VMV employing a solenoid actuated atmospheric bleed valve (EVR) for controlling the vacuum signal pressure on one side of a diaphragm operated regulator valve is shown and described in U.S. Pat. No. 5,277,167. The aforesaid known valve has a preload spring biasing the diaphragm operated regulator valve to the closed position such that a predetermined differential pressure across the diaphragm is required to cause the valve to open. In such an arrangement as the aforementioned known valve, the preload spring is set on the diaphragm to provide the desired amount of valve opening in response to certain predetermined levels of a manifold vacuum or depression during engine operation applied to control pressure chamber. The manifold vacuum applied to one side of the regulator valve diaphragm may be attenuated by electrically controlling the EVR solenoid valve to bleed atmospheric air into the vacuum signal chamber to modify or alter the vacuum in the control chamber in accordance with a pre-selected program of vapor purge suitable for various engine operating conditions, e.g., RPM and load. However, for a predetermined calibration of the preload spring for desired opening at a pre-selected level of manifold vacuum, the force of the preload spring is not sufficient to hold the regulator valve closed when the engine is shut off in the event that an abnormally high pressure is built up in the canister and applied to the opposite side of the diaphragm operating the regulator valve. Thus, the regulator valve diaphragm is lifted permitting undesired flow of fuel vapor from the canister to flow through the regulator valve and into the engine inlet and consequently to the atmosphere when the engine is not operating.

In the aforesaid known electrically operated VMV, the differential pressure across the regulator valve diaphragm required to open the regulator valve to permit canister vapor to enter the engine inlet is typically set at a value which corresponds to a desired level of engine manifold vacuum during engine operation. This is accomplished by the calibration of the diaphragm preload spring with a known vacuum signal provided at the inlet to the pressure signal chamber.

Thus, it has been desired to provide a way or means of preventing an electrically operated VMV from bleeding fuel vapor from the canister to the engine air inlet when the engine is not operating for an VMV valve that is calibrated to provide a desired flow in accordance with pre-selected level of engine manifold vacuum when the engine is operating. It has been particularly desired to provide a way or means of accomplishing this result without the need for costly redesign and retooling of an existing high volume production VMV.

BRIEF SUMMARY OF THE INVENTION

It is the object of the present invention to provide an electrically operated fuel vapor management valve (VMV) for controlling purge of engine fuel from a storage canister to the engine inlet during engine operation which may be controlled by an electrical control signal during engine operation and which does not open during engine off conditions when the vapor pressure in the fuel tank rises significantly above atmospheric pressure.

It is a further object of the present invention to prevent an existing electrically operated fuel vapor management valve from opening during engine off conditions with above atmospheric pressure in the fuel tank without requiring redesign and retooling of an existing high-volume production VMV. The VMV of the present invention employs, in one embodiment, interconnecting the atmospheric bleed inlet of the solenoid operated bleed valve (EVR) of an existing VMV to the vapor canister port to provide the canister pressure as a reference level for the EVR. In another embodiment, a shut-off valve is disposed in the line between the regulator valve vacuum pressure chamber inlet and the manifold vacuum source connection. The shut-off valve may be either electrically operated or a pressure differential operated valve.

In another embodiment, a slight modification to an existing valve is made to provide an additional valve seat for the EVR valve to provide a vacuum signal controlled by the same armature or valve plate which controls flow from the bleed inlet, which is connected to the canister to provide a reference signal at the same level of pressure as the vapor in the canister.

DETAILED DESCRIPTION OF THE INVENTION

Figure 1:
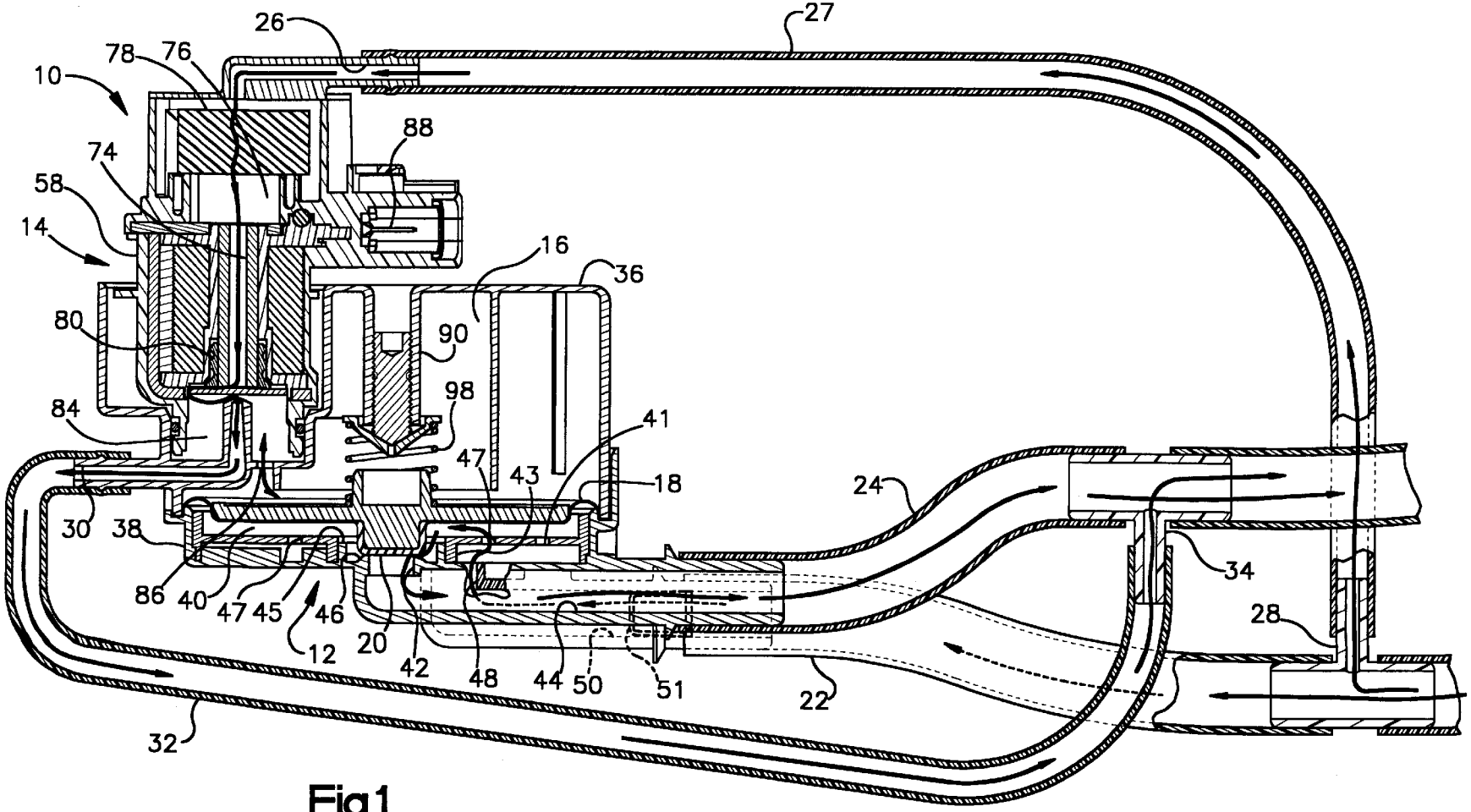
FIG. 1 is a cross-sectional view of one embodiment of the invention VMV having a modified solenoid EVR valve with a vacuum pressure tap forming a valve seat below the armature plate.
Figure 2:
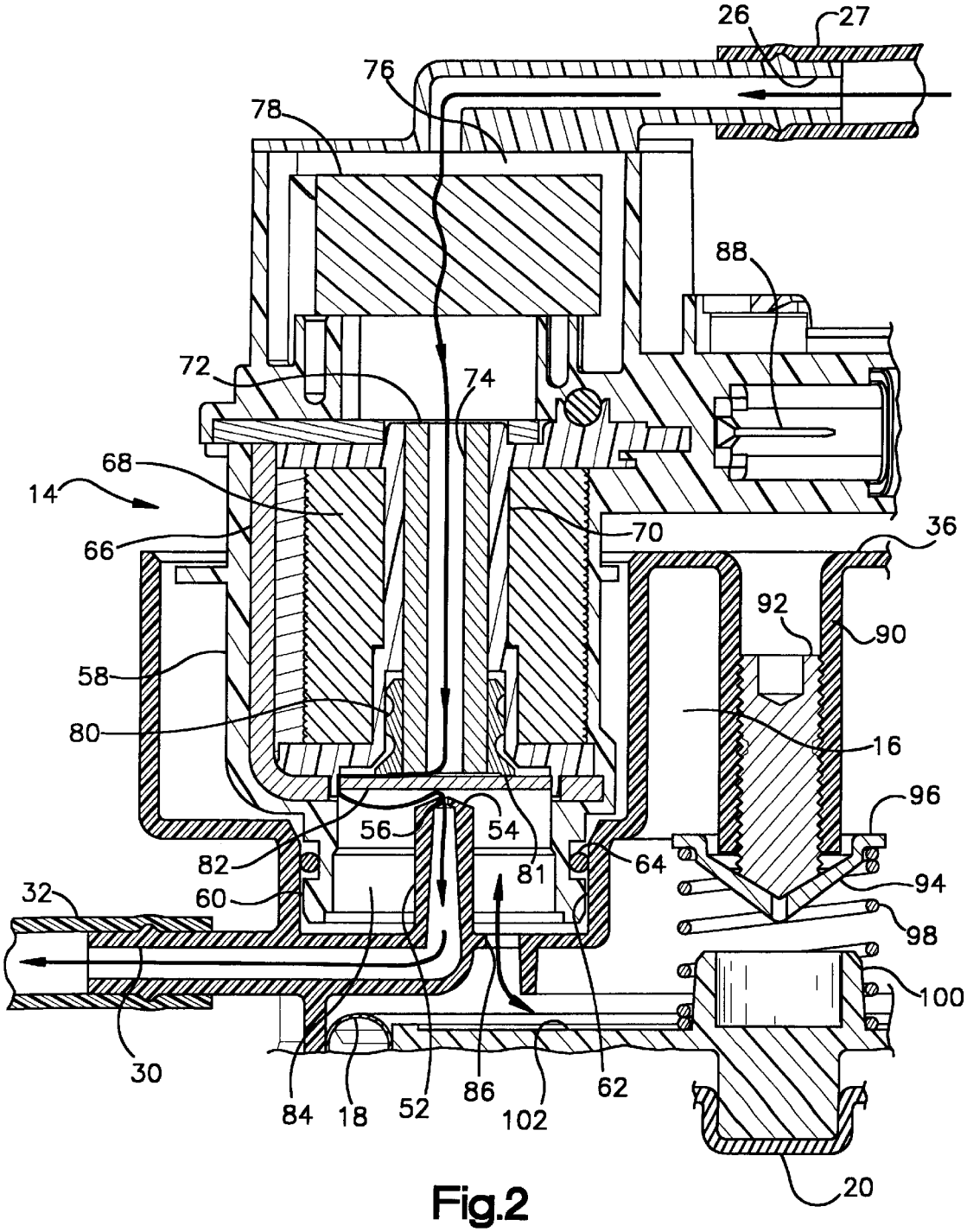
FIG. 2 is an enlarged view of the solenoid valve of FIG. 1.

Referring to FIGS. 1 and 2, the electrically operated fuel vapor purge regulator valve assembly or VMV of the present invention is indicated generally at 10 and has a diaphragm operated flow regulator valve indicated generally at 12 and an electrically operated solenoid type EVR bleed valve indicated generally at 14 which controls pressure in a chamber 16 formed on one side of a diaphragm 18 which moves regulator valve member 20 for controlling flow from an inlet line 22 connected to a fuel vapor purge canister (not shown) to an outlet line 24 connected to an engine air inlet or intake manifold (not shown). The EVR 14 has an inlet 26 connected via tubing 27 to a Tee 28 provided in the vapor line 22 from the canister. Valve 14 has an outlet 30 which is connected via line 32 to a second Tee 34 provided in the vacuum line 24 to the engine manifold.

The signal pressure chamber 16 is formed above the diaphragm by an upper shell 36 which seals the periphery of the diaphragm onto a lower shell 38 such that the diaphragm divides the housing created thereby into an upper chamber 16 above the diaphragm and a chamber 40 below the diaphragm, which chamber 40 has a valve seat 46 formed therein against which the valve member 20 is moved for controlling flow through passage 42 which communicates with the outlet 44 and tube 24 connected to the regulator valve.

Referring to FIG. 1, a diffuser plate 41 is disposed in chamber 40 and has an annular hub 43 which seals about an annular rib 45 formed in the lower shell about the valve seat 46 such that the plate 41 isolates the outlet passage 48 from the chamber 40 with the only communication therebetween being provided by a restrictive passage 47 formed through plate 41.

The chamber 40 is ported through restrictive passage 47 to an inlet passage 48 which communicates with an inlet fitting passage 50 connected to the inlet tube 22.

Outlet passage 50 has a restricting orifice device or insert 51 disposed therein through which tube 22 communicates with inlet passage 48.

The upper housing shell 36 has outlet passage 30 connected to a riser tube 52 which has formed on the upper end thereof a valve seat 54 with a restrictive orifice 56 formed therein communicating with outlet passage 30.

The electrically operated EVR bleed valve 14 has an outer casing or body thereof 58 which has a reduced diameter portion 60 at the lower end thereof which is received in a cavity or well 62 formed in the upper shell 36 and sealed therein by an annular seal ring 64. Valve body 58 houses or has disposed therein a magnetic pole piece or frame 66 disposed about a coil 68 wound on a bobbin 70 which has received centrally therethrough a tubular pole piece 72 which has a central passage 74 therethrough. The upper end of passage 74 communicates with chamber 76 and through a filter 78 with the inlet passage 26.

The lower end of tubular pole piece 72 has an annular sleeve 80 disposed thereabout which is formed of non-magnetic material and which provides at its lower end a seat 81 for a moveable armature or valve plate 82. Upward movement of the valve plate 82 is limited by seat 81 and, downward movement of the valve plate 82 is limited by contact with valve seat 54. It will be understood that the lower end 81 of the sleeve 80 forms a valve seat for the upper surface of plate 82 as the valve seat 62 does for the lower surface of plate 82. When the plate contacts the valve seat 62 to close restrictor orifice 56, passage 74 is opened to a chamber 84 formed by the valve body and the lower well 62.

Chamber 84 is connected to the signal pressure chamber 16 by a passage 86 formed in the bottom of the well 62.

The coil 68 is connected to at least one electrical connector terminal as denoted by reference numeral 88 for connection to an external electrical control signal source (not shown).

It will be understood that passage 86 is sized to readily permit pressure equalization between chamber 84 and chamber 16 and is not intended to be a restrictor.

Upper shell 36 has provided thereon, preferably integrally formed therewith, a tubular extension or projection 90 extending downwardly from the inner surface thereof into chamber 16. Projection 90 has threadedly engaged therein an adjustment screw 92 which has the lower end thereof registered on a cap 94 which has an outwardly extending flange 96 which has the undersurface thereof shouldered and registered against the upper end of the preload spring 98 which has its lower end received over a pilot projection 100. The lower end of the spring 98 is registered against the upper surface of a diaphragm backing plate 102 which has the valve member 20 which preferably comprises a thickened central portion of diaphragm 18 disposed thereon.

In operation, with the engine shut off, the embodiment illustrated in FIGS. 1 and 2 has valve plate 82 biased closed against valve seat 54 by the pressure of the fuel vapor in the canister entering inlet 26 of valve 14; and, regulator valve 20 is biased against valve seat 46 by spring 98 to prevent fuel vapor from the canister entering passage 48 and chamber 40 via restrictor passages 47 from flowing out through outlet passage 44.

When the engine is shut off, the canister vapor pressure entering the EVR inlet 26 is applied through passage 74 to chamber 84 and through passage 86 to chamber 16 thus equalizing the pressure in chamber 16 and chamber 40 so that a zero pressure differential exists across the diaphragm 18 and the spring 98 can maintain the valve 20 closed.

Upon engine startup, application of manifold vacuum through lines 24 and 32 through the Tee 34 does not cause regulator valve 20 to open inasmuch as the valve plate 82 is closed against valve seat 54 and vacuum cannot be applied to the chamber 84. Similarly, application of engine manifold vacuum through line 24 creates a depression or vacuum in chamber 40 which serves to create a differential pressure across diaphragm 18 assisting spring 98 in holding regulator valve 20 closed.

Upon energization of the valve 14, from a suitable electronic controller (not shown) armature or valve plate 82 is lifted from valve seat 54 and seated against seat 81 permitting engine manifold vacuum applied through tube 32 to passage 30 and restrictor orifice 56 to create a vacuum in chambers 84 and 16 thereby creating a pressure differential across diaphragm 18 which pressure differential applied across the effective area of diaphragm 18 creates an upward force on the diaphragm 18 overcoming the bias of spring 98 and lifting valve 20 from the valve seat 46 thus permitting fuel vapor from passage 50 to flow through passage 48 to chamber 40 and outwardly through passage 44 to the engine manifold through tube 24 and Tee 34.

For a given level of engine manifold vacuum the diaphragm will seek an equilibrium position between the load of spring 98 and the differential pressure forces acting on the effective area of the diaphragm and thus move the valve member 20 to regulate the pressure in chamber 40 and thereby control flow of fuel vapor from the canister through the passage 42 and tube 24 to the engine manifold. As the engine manifold vacuum changes, the diaphragm 18 will move to a new equilibrium position and thus control the pressure drop across the restricting orifices in device 51 and orifices 47 in the diffuser plate to control flow over valve seat 46.

In operation, upon energization of EVR 14, valve plate 82 is raised by the magnetic force of the coil 68 against the annular surface of the lower end of sleeve 80 which acts as a valve seat and closes passage 74 and opens orifice 56 to permit a vacuum to be drawn in chambers 84 and 16. When the differential pressure between passage 74 and chamber 84, acting on the plate 82 over the area of the end of sleeve 80, provides a force greater than the magnetic force of the coil 68, plate 82 is lowered to re-close orifice 56, thereby decreasing the pressure differential on plate 82. The action of the EVR is thus that of a regulator valve, with the regulated pressure setting being determined by the coil energization current.

The electrical control signal applied to the valve 14 thus effectively controls the pressure in the chamber 16 above the diaphragm, in the face of varying engine manifold vacuum in order to provide the desired purge flow of fuel vapor from the canister line 22 to the engine manifold inlet line 24.

By referencing the signal pressure control chamber 16 above the regulator valve diaphragm 18 to vapor canister pressure applied through Tee 28, the vapor management valve arrangement 10 of FIG. 1 thus provides the desired electrical control of canister vapor purge during engine operation but prevents excessive pressure in the canister from opening the valve 20 during periods when the engine is shut off.

Figure 3:
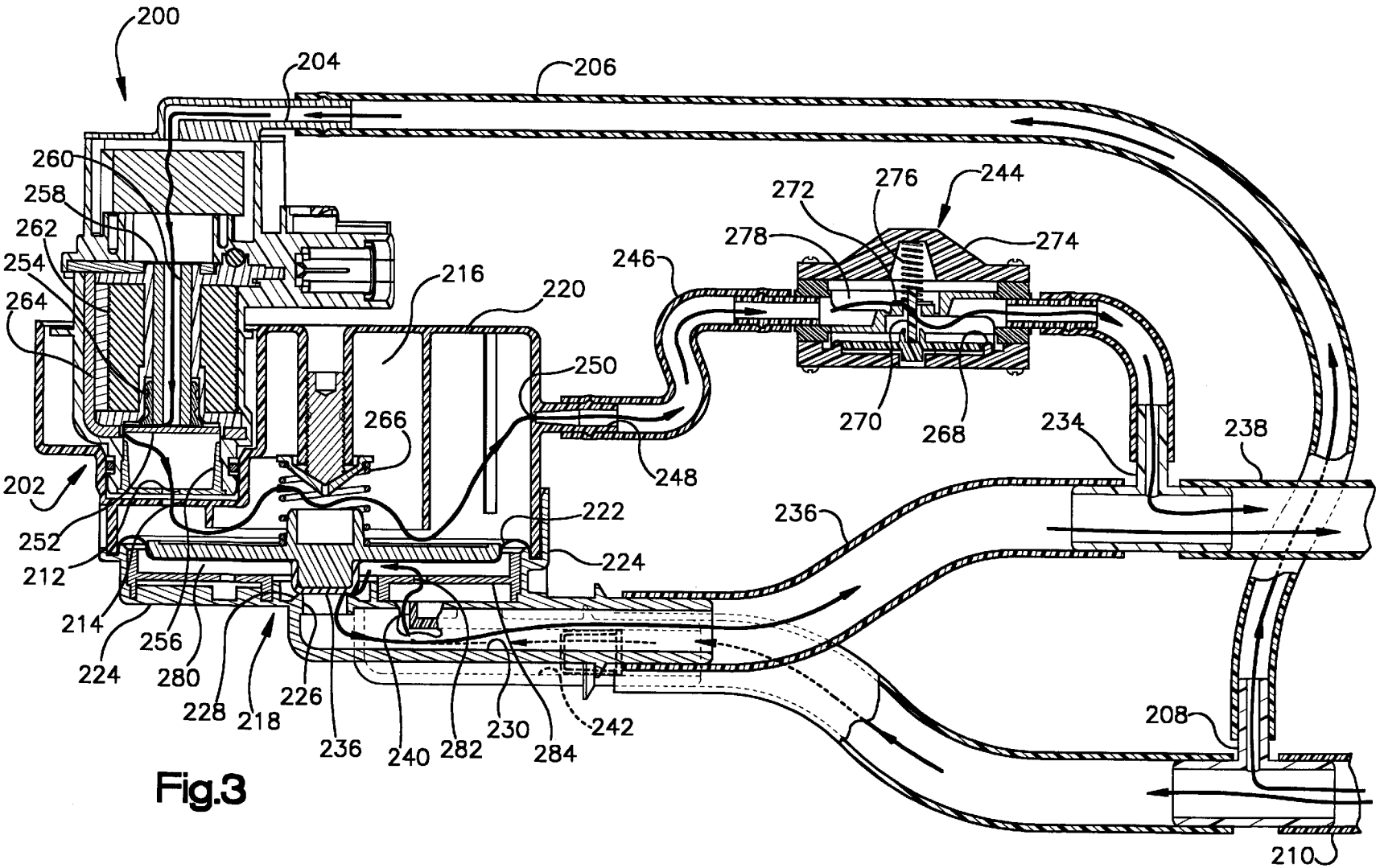
FIG. 3 is an alternative embodiment of the invention utilizing an existing VMV employing the EVR referenced to canister pressure and a pressure operated shut-off valve provided in the manifold vacuum line to the signal pressure chamber for the regulator valve diaphragm; and, FIG. 4 is a view similar to FIG. 3 showing an electrically operated shut-off valve in the manifold vacuum line.

Referring to FIG. 3, another embodiment of the vapor management valve is indicated generally at 200 and includes a solenoid operated EVR indicated generally at 202. Valve 200 is of an existing design without modification, having the valve inlet passage 204 connected via tube 206 to a Tee 208 which is connected to a line 210 receiving fuel vapor from a storage canister (not shown). The outlet of valve 202 denoted by reference numeral 212 communicates with an inlet passage 214 of a control signal pressure chamber 216 provided in a regulator valve assembly indicated generally at 218. The regulator valve assembly includes an upper shell 220 sealed over a pressure responsive diaphragm 222 in a lower shell 224 which has an outlet passage 226 from a valve seat 228 communicating with an outlet fitting passage 230 which is connected to a tube 232 which in turn is connected to a Tee 234. Tee 234 is connected via tubing 238 to a source (not shown) of engine inlet manifold vacuum.

Diaphragm 222 includes a valve member 236 moveable with respect to the valve seat 228 for controlling flow from an inlet passage 240 which communicates with an outlet fitting passage 242 which is connected to the tube 232. The valve assembly 202 also has a spring 266 which provides a preload for biasing the diaphragm in a downward direction.

Tee 234 is connected through a tubing 235 to a shut-off valve indicated generally at 244 which has its inlet connected through tube 246 to a fitting 248 which communicates with a restrictor orifice 250 porting control signal pressure chamber 216.

The valve 202 has a pole piece 258 having a central passage 260 which communicates the inlet 204 with the outlet 212 when valve member 252 is away from seat 254. A coil 262 surrounds the pole piece 258 and a magnetic pole piece or frame 264 surrounds the coil for providing a flux loop thereabout. Valve 202 includes a moveable valve member or armature 252 which has its upper surface seated against the lower end of a nonmagnetic sleeve 254 provided in the valve about pole member 258 and its downward travel limited by stop member 256.

In the embodiment of FIG. 3, the shut-off valve 244 employs a pressure responsive diaphragm 268 which is attached by a rod 270 to a moveable valve member 272 which is moveable with respect to a valve seat 274 for controlling flow to outlet Tee 234. A spring 276 biases valve 274 to the closed position; and, the valve seat also communicates with a chamber 278 ported to the inlet tube 246.

In operation, valve 244 is in the closed state with the engine shut off. Upon engine startup, the engine manifold vacuum in Tee 234 acting across the effective area of diaphragm 268 in valve 244 causes valve member 272 to lift from its valve seat and permit engine manifold vacuum to communicate through tube 246 and restrictive orifice 250 to apply vacuum to pressure chamber 216 in regulator valve 218.

With the engine shut off, fuel vapor pressure applied through tube 210 from a storage canister to Tee 208 is applied through tube 206 to the reference inlet 204 of valve 202 and flows through the passage 260 and around the open valve member 252 through outlet 212 and regulator inlet orifice 214 to chamber 216.

The pressure in Tee 208 is also applied through tubing 241 to inlet passages 242 and 240 to a chamber 280 via passages 282 in diffuser plate 284 and thus equalizes the pressure on the diaphragm such that spring 266 can maintain the valve 236 closed against valve seat 228.

The fuel vapor in chamber 216 is thus blocked from flowing to Tee 234 by the normally closed condition of valve 244.

In operation, with the engine running and EVR valve 202 in the "OFF" condition or deenergized, engine manifold vacuum is applied through line 238 and Tee 234 to the inlet of valve 244 and through orifice 250 to chamber 216. Simultaneously, the manifold vacuum is applied through tube 236 and passage 230 and 240 to chamber 280. With valve 202 in the deenergized condition a small amount of fuel vapor bleed flow occurs from valve inlet 204 through passage 260 and passages 252, 214 through orifice 250 and valve 244 to the engine manifold through tubing 238. However, restrictor orifice 250 is sufficiently small that this residual or bleed flow is of little or no significance in effecting purge flow of a storage canister or in effecting engine operation.

With the engine running and the EVR 202 deenergized, the manifold vacuum applied through passage 230 and passage 226 to chamber 280 creates a pressure differential between chamber 280 and chamber 216 which acts upon the effective area of diaphragm 222 in addition to the force of spring 266 to maintain valve 236 closed against valve seat 228.

With the engine running when the EVR 202 is energized, valve plate 252 is raised against seat 254 thereby restricting flow of fuel vapor through the valve outlet 212 to chamber 216; and, the effect of manifold vacuum applied to restrictor orifice 250 creates a vacuum in chamber 216 which creates a pressure differential across diaphragm 222 which is applied to the effective area of the diaphragm and acts against the force of spring 266 to lift the valve member 236 and permit flow through outlet 226 and 230 to the engine inlet. The percentage of time that the EVR 202 is energized determines the level of the vacuum in chamber 216.

The diaphragm 222 seeks an equilibrium position such that the force of spring 266 and the pressure differential between chamber 216 and chamber 240 acting across the effective area of the diaphragm balance. The valve is thus positioned to control the flow through passage 226.

In the present practice of the invention, in a typical engine application the regulator valve 218 is set to open at about 17 millimeters Hg pressure differential across the diaphragm 222.

Figure 4:
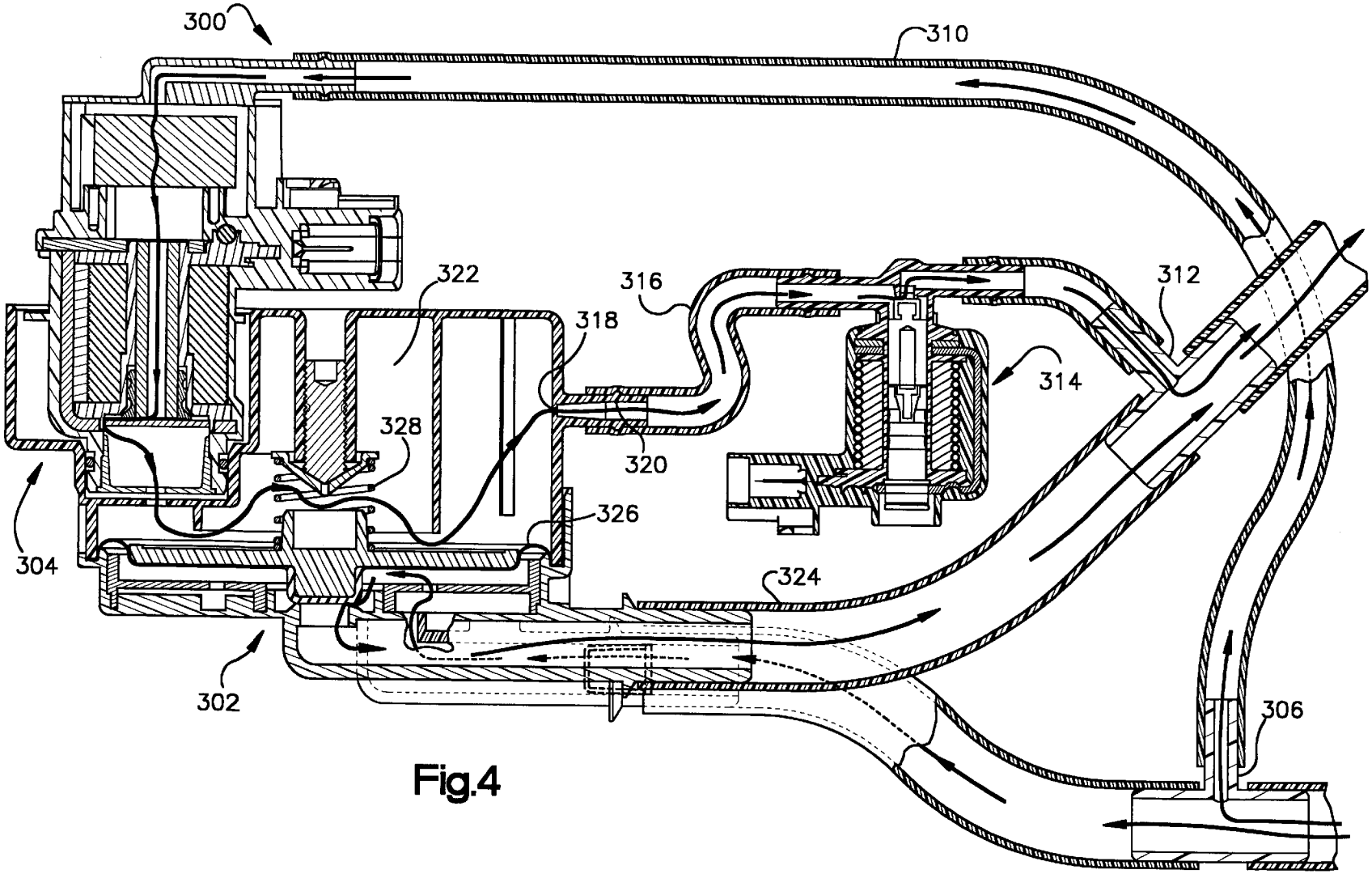

Referring to FIG. 4, an alternative embodiment of the vapor management valve of the present invention is indicated generally at 300 and includes a regulator valve 302 and an EVR 304 which is identical to the EVR of FIG. 3. The reference or bleed port of valve 304 is connected to a fuel vapor canister line Tee 306 via tubes 310. The inlet of regulator valve 302 is also connected to Tee 306 via tubing 308. The outlet of regulator valve 302 is connected to a manifold vacuum line Tee 312 which is also connected through an electrically operated shut-off valve indicated generally at 314 which has its inlet connected through tube 316 to a vacuum port 320 provided in the regulator valve 302 which communicates with a restrictor 318 provided therein identical to the restrictor 250 in the embodiment of FIG. 3. Restrictor communicates with a vacuum signal pressure chamber 322 provided in valve 302.

In operation, the embodiment of FIG. 4 functions identically to that of the FIG. 3 embodiment except that electrical energization of valve 314 is required to permit vacuum communication between Tee 312 and the vacuum port 320 of regulator valve 302. Thus, even with the engine running and EVR 304 admitting fuel vapor to chamber 322, unless shut-off valve 314 is electrically opened, fuel vapor from chamber 322 cannot enter Tee 312. Furthermore, with the engine running, no vacuum signal can be applied to port 320 and chamber 322 unless valve 314 is electrically energized and thus regulator valve remains closed, as, the vacuum applied through tubing 324 to the outlet of regulator valve 302 creates a pressure differential across the diaphragm 326 which aids spring 328 in closing the valve 302. The embodiment of FIG. 4 also prevents fuel vapor flow through regulator valve 302 when the engine is off irrespective of the pressure rise of the vapor in the fuel canister as applied through Tee 306.

The present invention thus provides a fuel tank vapor canister purge valve assembly or VMV which employs an electrically operated bleed valve or EVR for controlling pressure in a signal pressure chamber on one side of a diaphragm operated regulator valve and prevents elevated pressure from the vapor storage canister from opening the regulator valve when the engine is shut off. The assembly of the present invention may be employed with a simple modification to an existing VMV in one embodiment without requiring complete retooling of the existing VMV. In another embodiment, an existing VMV may be utilized as is with the addition of a positive shut off valve in the manifold vacuum line to the control signal pressure chamber. The shut-off valve may either be vacuum operated or electrically operated. In both embodiments, the bleed inlet of the EVR is referenced to the fuel vapor pressure from the canister rather than operating as an atmospheric bleed valve for controlling vacuum pressure in a control chamber for electrically controlling the pressure differential across the regulator valve diaphragm.

Although the invention has hereinabove been described with respect to the illustrated embodiments, it will be understood that the invention is capable of modification and variation and is limited only by the following claims.

What is claimed is:

1. A fuel vapor purge control system for use in controlling flow from a vapor storage canister to an engine intake manifold vacuum port, said system comprising:

(a) a main regulator valve having an inlet and outlet including a pressure responsive member forming a moveable wall of a chamber and operable for moving a valve member for controlling flow over a valve seat disposed between said inlet and said outlet;

(b) an electrically operated bleed valve having the inlet thereof connected to said canister and the outlet thereof connected to said chamber;

(c) a normally closed shut-off valve disposed to have its inlet connected to said chamber and its outlet connected to said vacuum port, wherein upon opening of said secondary valve, said chamber is connected to said vacuum port; and, (d) upon energization of said bleed valve, pressure in said chamber is regulated to affect control of said regulator valve.

2. The system defined in claim 1, wherein said shut-off valve is operated by a pressure responsive member.

3. The system defined in claim 1, wherein said shut-off valve is electrically operated.

4. The system defined in claim 1, wherein said shut-off valve is operated by a pressure responsive diaphragm.

5. The system defined in claim 1, wherein said shut-off valve is solenoid operated.

6. A method of controlling fuel vapor flow from a canister to an engine intake manifold vacuum port comprising:

(a) providing a pressure regulator valve having a housing with pressure responsive member and forming a chamber in said housing having said pressure responsive member as a wall of said chamber and moving said wall and controlling flow through an orifice in the flow path between the canister and said manifold vacuum port;

(b) connecting the inlet of an electric valve to said canister and connecting the outlet of electric valve to said chamber;

(c) providing a normally closed auxiliary valve and connecting the inlet thereof to said chamber and connecting the outlet thereof to said manifold vacuum port;

(d) opening said auxiliary valve and permitting flow between said manifold vacuum port and said chamber; and, (e) energizing said electric valve and regulating the pressure in said chamber and moving said pressure responsive member and controlling flow through said orifice.

7. The method defined in claim 6, wherein said step of energizing said main electric valve includes energizing with a periodic signal.

8. The method defined in claim 6, wherein said step of energizing said main electric valve includes energizing with a modulated signal.

9. The method defined in claim 6, wherein said step of opening said auxiliary valve includes electrically energizing a solenoid.

10. The method defined in claim 6, wherein said step of opening said auxiliary valve includes disposing a pressure responsive member between the inlet and outlet thereof and moving said member in response to a predetermined pressure difference between the inlet and outlet.

11. The method defined in claim 10, wherein said step of moving includes preloading said pressure responsive member.

* * * * *